US006129022A

United States Patent [19]

Hickey et al.

[11] Patent Number: 6,129,022

[45] Date of Patent: Oct. 10, 2000

[54] AMMUNITION SAFETY AND ARMING UNIT

[75] Inventors: Dennis J Hickey, Preston; John G Rawcliffe, Bury, both of United Kingdom

[73] Assignee: Royal Ordnance PLC, Chorley, United Kingdom

[21] Appl. No.: 09/441,378

[22] Filed: Nov. 17, 1999

Related U.S. Application Data

[63] Continuation of application No. PCT/GB99/02799, Aug. 24, 1999.

[30] Foreign Application Priority Data

Aug. 28, 1998 [GB] United Kingdom ..... 9818673

[51] Int. Cl.[7] ..... F42C 15/00

[52] U.S. Cl. ..... 102/221; 102/215; 102/247; 102/262

[58] Field of Search ..... 102/215, 216, 102/221, 231, 232, 247, 248, 262; 89/6, 6.5

[56] References Cited

U.S. PATENT DOCUMENTS

| | | | |
|---|---|---|---|
| 2,889,777 | 6/1959 | Rabinow | 102/216 |
| 3,851,531 | 12/1974 | White et al. | 73/510 |
| 3,955,508 | 5/1976 | Will et al. | 102/248 |
| 4,013,012 | 3/1977 | Giattino . | |
| 4,023,498 | 5/1977 | Harris | 102/262 |
| 4,574,168 | 3/1986 | Devaney | 102/262 |
| 5,251,548 | 10/1993 | Spence | 102/221 |

FOREIGN PATENT DOCUMENTS

| | | | |
|---|---|---|---|
| 3506412 | 8/1986 | Germany | 102/262 |
| 3 543 938 | 7/1987 | Germany . | |
| 3 925 000 | 9/1997 | Germany . | |
| 1 388 953 | 4/1975 | United Kingdom . | |

*Primary Examiner*—Harold J. Tudor
*Attorney, Agent, or Firm*—Nixon & Vanderhye P.C.

[57] ABSTRACT

A safety and arming unit for a round of ammunition, comprising one or more acceleration sensors for detecting when the acceleration of the ammunition reaches at least two different predetermined linear acceleration values; timer means for measuring the time interval between the detection of two of the predetermined linear acceleration values, means for electronically comparing the said measured time interval with a range of predetermined and pre-set time intervals representing satisfactory firing for the round of ammunition, and means for producing an electronic signal when the said measured time interval falls within the range of predetermined and pre-set time intervals, which signal operates to arm the ammunition ready for detonation.

10 Claims, 4 Drawing Sheets

AMMUNITION SAFETY AND ARMING UNIT

This is a continuation of PCT application PCT/GB99/02799, filed Aug. 24, 1999, now WO 00/12953 published on Mar. 9, 2000, the entire content of which is hereby incorporated by reference in this application.

The present invention relates to safety and arming systems for ammunition fuzes.

For reasons of safety, rounds of ammunition which have an explosive payload require systems which render them safe from inadvertent or accidental detonation on the ground during handling or in the launcher, and which arm them only on or after launch and prior to reaching their target.

For the purposes of this patent specification, ammunition is taken to include but is not limited to artillery shells and charges, mortar rounds, rockets and missiles.

Mechanical safety means capable of enabling a firing circuit of a detonator, for detonating the explosive charge within the ammunition, are known. These safety means may be adapted to respond when ammunition reaches a predetermined position, time or proximity to a target for example. Mechanical safety and arming devices, for spun rounds that are fired from rifled guns or unspun rounds fired from smooth bore guns, generally comprise an inertia device such as a safety pin or detent which operates only under the high forces generated by firing or launch to arm the fuze by physically moving from a position which prevents detonation of the charge to one which permits this. Spun rounds fired from rifled bores, such as artillery shells for example, may have known mechanical safety and arming devices operated by the effects of centrifugal force, for example on a spring and mass system. As unspun rounds do not experience any significant centrifugal force, this type of ammunition may have mechanical safety and arming devices actuated by air pressure. As an example, U.S. Pat. No. 4,526,104 proposes to utilise air pressure effects by means of elevating a pitot tube into the surrounding airflow after launch and during flight of the round.

Although mechanical safety and arming means are widely used and are reasonably reliable, it is not advantageous to have a bulky mechanical arming and safety device adding weight and requiring space in the fuze. Furthermore, although the size and weight of mechanical safety and arming devices have reduced significantly in recent years, the size and weight of some ammunition have also reduced. Additionally, an increasing improvement in performance of ammunition is continuously being sought. The time needed to manufacture and the cost of manufacturing mechanical safety and arming devices increases significantly as these devices become smaller and require their mechanisms to be precision engineered.

Electronically operated safety and arming systems are not widely used in fuzes, but electronic devices capable of sensing accelerations, known as accelerometers, have been used in the vehicle industry for crash sensing. Known accelerometers are generally regarded as being unsuitable for use in the safety and arming systems of fuzes as they are separate from the fuzing system, only measuring acceleration and needing to communicate this information to the safety and arming system, and further requiring complex processing of their output signals before the separate safety and arming system can respond. For safety and arming systems it is undesirable to use an accelerometer because of the need to integrate this complex system successfully with the safety and arming system in order to enable the fuze to operate with the required high level of reliability. Indeed it is usually a primary safety requirement that the safety and arming system is one integral system which can be readily integrated into an electronic fuze.

The present invention seeks to provide an integral safety and arming unit for ammunition which operates by sensing and responding to acceleration. It further seeks to provide a safety and arming unit which is small, light and reliable. The predominantly electronic safety and arming unit reduces moving parts and does not require extensive precision engineering. Less complex electronic safety and arming systems are quicker and cheaper to manufacture than known safety and arming systems having mechanical acceleration responsive devices.

According to the present invention there is provided a safety and arming unit for a round of ammunition, comprising one or more acceleration sensors for detecting when the acceleration of the ammunition reaches at least two different predetermined linear acceleration values; timer means for measuring the time interval between the detection of two of the predetermined linear acceleration values, means for electronically comparing the said measured time interval with a range of predetermined and pre-set time intervals representing satisfactory firing for the round of ammunition, and means for producing an electronic signal when the said measured time interval falls within the range of predetermined and pre-set time intervals, which signal operates to arm the ammunition ready for detonation.

The safety and arming unit may comprise at least one acceleration sensor capable of detecting at least two predetermined linear acceleration values. Alternatively the unit may comprise at least two acceleration sensors, each being capable of detecting one predetermined linear acceleration value.

Preferably at least one sensor detects a threshold lower acceleration value and at least one further sensor detects a threshold upper acceleration value. Advantageously several sensors may be provided to detect the same threshold acceleration value.

One suitable type of sensor comprises a spring mass system having a first electrical contact on the mass and a second electrical contact initially not in contact with the mass. A predetermined force corresponding to a linear acceleration value is capable, in this sensor, of causing the mass to compress a spring and touch the second electrical contact. In this manner, the spring mass system acts as a switch being open initially and closing at a threshold acceleration value to complete an electrical circuit.

Another suitable type of sensor is in the form of a cantilever threshold switch, where the sensor comprises a cantilever fixed at one end and having an electrical contact and mass at the other, free end, which free end is close to a second electrical contact such that on launch of the ammunition the cantilever moves due to the launch acceleration to make contact with the second electrical contact and complete a circuit.

A further suitable type of sensor is in the form of a cantilever comprising piezoresistive material such as piezocrystal. The cantilever in this sensor is connected to an electrical circuit such that current may flow through the length of the cantilever containing the piezoresistive material. The piezoresistive material undergoes strain and therefore a change in its resistivity on launch of the ammunition, such that the current flowing through it is changed and this change may be detected.

The sensor may alternatively comprise an optical spring mass acceleration system which acts on launch of the ammunition in the same way as the spring mass system described above, but instead of utilising electrical contacts, the sensor instead comprises a light beam generator and a receiver, such that as the mass moves it may interrupt a light beam and this interruption may be detected.

The acceleration sensor or sensors used in the safety and arming unit preferably form an integral part of the safety and arming system of a fuze.

In order that the present invention may be more fully understood, examples will now be described by way of illustration only with reference to the accompanying drawings of which:

FIG. 1*a* shows a typical acceleration versus time graph for a particular artillery shell in the period from being fired up to exit from the muzzle for a successful firing.

FIG. 1*b* shows an acceleration versus time graph for the same artillery shell as in FIG. 1A when it is misfired.

FIG. 2 shows a schematic diagram of sequential operations of a safety and arming unit capable of sensing and responding to a predetermined acceleration in accordance with the present invention.

FIG. 3*a* shows a spring mass acceleration sensor for use in a safety and arming unit according to the present invention, when it has not yet detected a predetermined acceleration value.

FIG. 3*b* shows the sensor of FIG. 3*a* when it has detected a predetermined acceleration value.

FIG. 4*a* shows a three dimensional view of cantilever acceleration sensors for use in a safety and arming unit according to the present invention.

FIG. 4*b* shows a plan view of a pair of cantilever acceleration sensors similar to those shown in FIG. 4*a*.

Figure 1A:
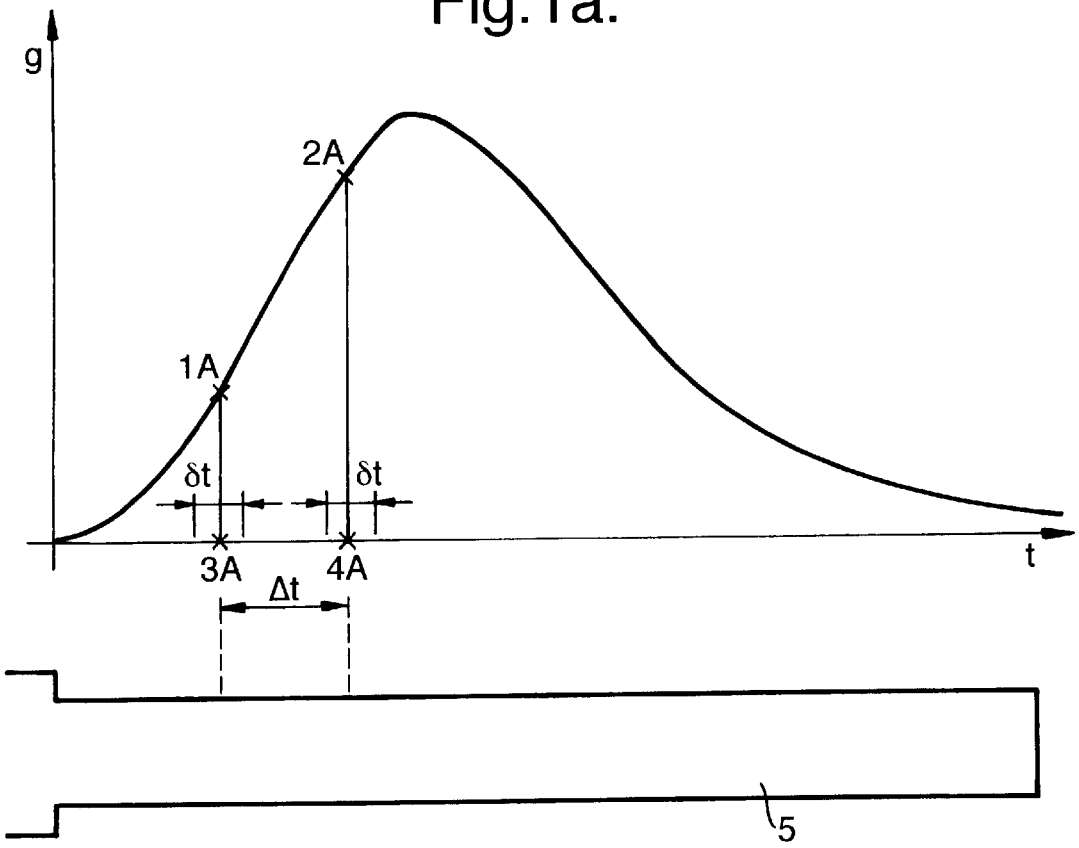

Referring now to the drawings and where the same features are denoted by common reference numerals.

FIG. 1*a* shows a graph of acceleration against time for an artillery shell undergoing a successful firing, from initiation up to the moment where it leaves the muzzle of the howitzer barrel 5. It can be seen that the shell accelerates rapidly at the initiation of firing and then the acceleration gradually decreases until the shell leaves the muzzle at a near constant velocity.

Figure 1B:
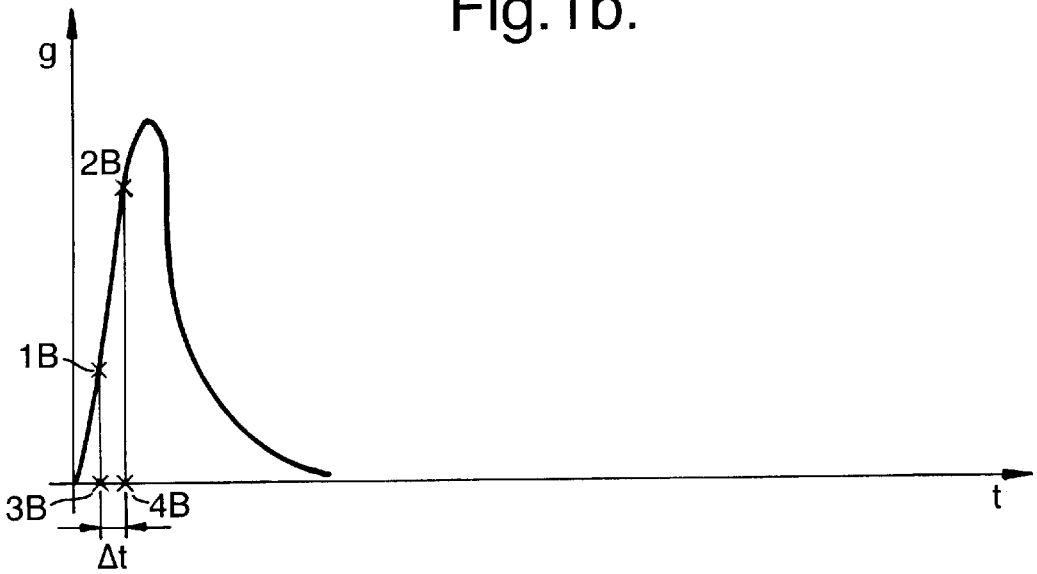

FIG. 1*b* shows a graph of acceleration against time for a similar artillery shell under a condition producing high acceleration forces, for example if the shell is misfired. The profile of the curve is very different and even if an event produces a similar maximum acceleration value to the successful firing event it happens in a much shorter time scale. It is therefore beneficial to have a safety and arming system in a fuze which can not only recognise and respond to a change in the acceleration of a shell or missile but which can further recognise whether the acceleration change is due to a successful firing or other circumstances, for example, by considering time corresponding to the change in acceleration. For ammunition, acceleration versus time graphs can easily be produced through calculation and test data for successful firing of each type of ammunition with a particular charge. Acceleration sensors can be produced for detecting the acceleration values particular to a specific type of ammunition and charge in accordance with the acceleration characteristics shown in the graphs.

For the particular shell whose acceleration characteristics are shown in FIG. 1*a,* point 1A represents a threshold value of acceleration due to firing at which a first acceleration sensor is designed to respond by producing an electrical signal. From FIG. 1*a* it can be seen that this occurs at a time 3A. As the shell accelerates in the barrel of the launcher it will reach, at a time 4A, a second threshold value of acceleration 2A at which a second acceleration sensor is designed to respond by producing another electrical signal. The time differential $\Delta t$ should be the same between points 3A and 4A for all shells fired of that type with the same charge assuming that the shells conform precisely to their design characteristics. However, due to slight variations in performance of the ammunition, successfully firing many shells of the type shown in FIG. 1*a* will naturally lead to a distribution $\delta t$ around each of the points 3A and 4A but this value will be much less than $\Delta t$. If the shell experiences the acceleration shown in FIG. 1*b,* the first and second acceleration sensors will respond at times 3B and 4B corresponding to the accelerations 1B and 2B respectively, but it will be seen that the time differential $\Delta t$ is substantially different to that of FIG. 1*a,* and so the acceleration sensor will not respond in accordance with the description of FIG. 2 below. In these circumstances the safety and arming system will not therefore arm the round of ammunition, which will continue to its target but will not detonate or explode.

Figure 2:
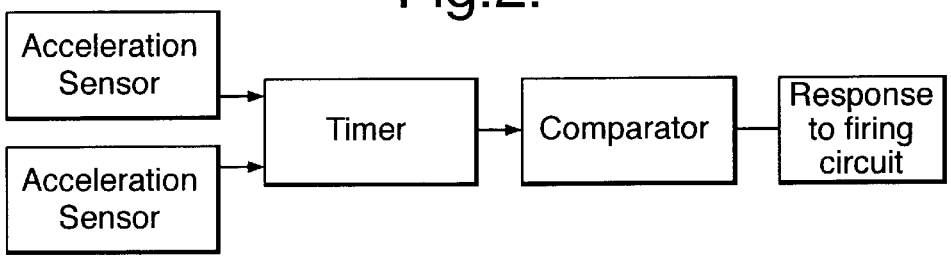

As shown schematically in FIG. 2, as a first acceleration sensor detects the threshold acceleration 1A of FIG. 1*a* and responds under the force generated by the acceleration, a timer receives a signal from this sensor and begins to count. When the second acceleration sensor detects its threshold acceleration 2A and responds in a manner similar to the first sensor, the timer receives a second signal from the second sensor causing it to stop counting. The timer records a differential time $\Delta t$ in this manner and this $\Delta t$ value is then compared by a comparator with the allowable range of $\Delta t$ values held in the comparator which represent a successful firing of the ammunition in accordance with the acceleration versus time graph for that ammunition and charge. If the timer records a differential time $\Delta t$ within the acceptable range for that ammunition, the comparator causes an electrical signal to be sent immediately to the firing circuit and the detonator to cause the fuze to become armed. The ammunition would then be detonated by separate position, time, proximity or other detonation means.

Figure 3A:
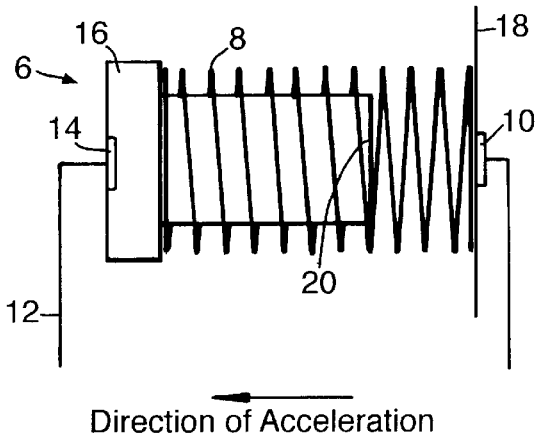
Figure 3B:
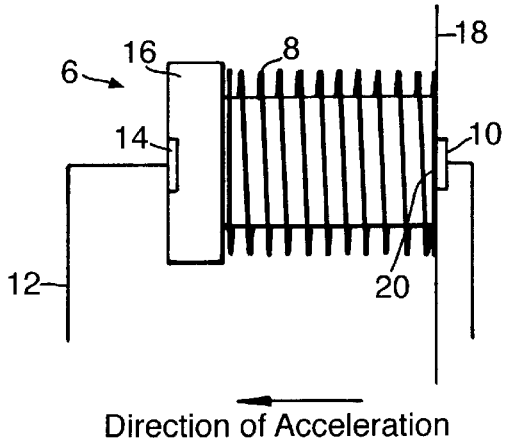

FIG. 3*a* shows a sensor comprising a spring mass system 6 for detecting linear acceleration. The system comprises a mass 16, capable of linear movement when a linear acceleration is applied and having electrically conductive properties. The mass 16 has a head portion 80 and a body portion 82. A non-conducting helical spring 8 is located around the body portion 82 with one end 84 of the spring 8 abutting the inner annular face 86 of the head portion 80. The other end 88 of the helical spring 8 is attached to a base plate 18. Electrical contacts 14 and 10 are connected to the conductive mass 16 and to the base plate 18 respectively as shown. The end 20 of the mass 16 is not in contact with the contact 10 and so the circuit 12 is open. FIG. 3*b* shows the system 6 at a pre-determined acceleration value when the force due to acceleration acting on the mass 16 has caused the spring 8 to compress such that the end 20 of the mass 16 has touched and made electrical contact with the contact 10, thus closing the switch and completing the circuit 12. In this embodiment of the invention two such sensors are used, each arranged such that a different pre-determined acceleration is necessary to close the contacts. The first switch has a lower threshold acceleration value and the second has a higher one, controlled by the stiffness of the spring. Referring back to FIG. 2, as the first spring mass system responds under its threshold acceleration and completes the circuit 12, a signal is sent to the timer. Similarly, as the second spring mass system responds to its higher threshold acceleration and closes the circuit 12, a second signal is sent to the timer. The timer records the time differential Δt between the two signals and passes this to the comparator for comparison with the stored values of time differential Δt as described earlier.

Figure 4A:
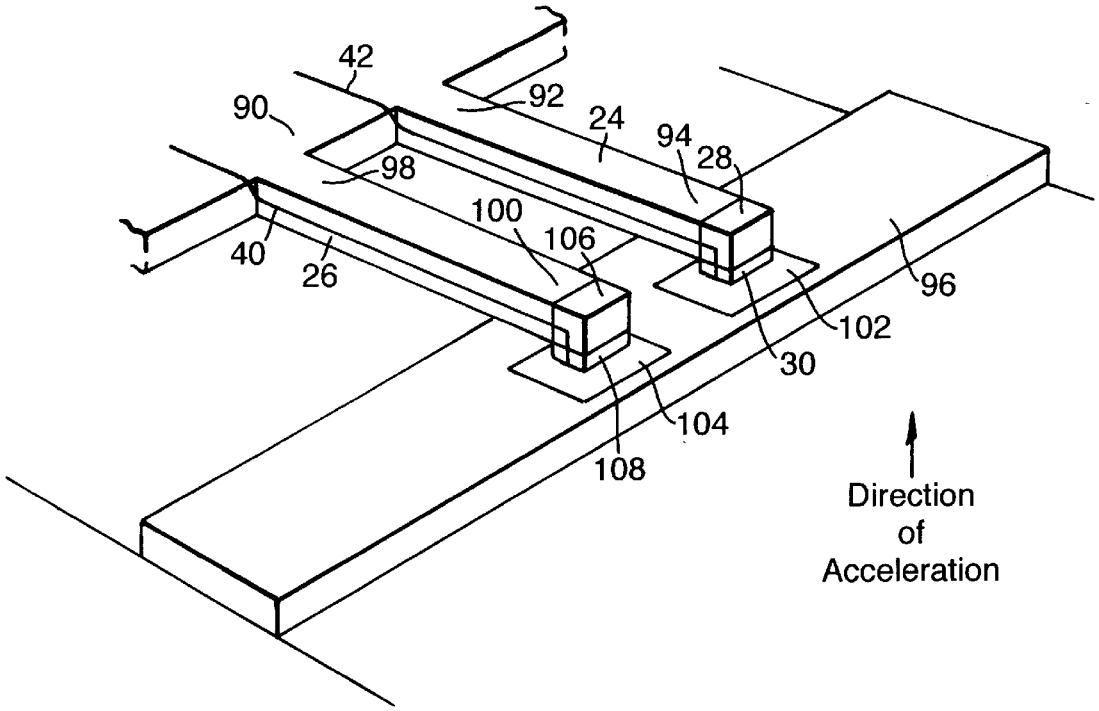

FIG. 4*a* shows a sensor comprising cantilevers 24,26. Each cantilever 24,26 has one end 92, 98 fixed to a support 90 and another end 94, 100 which is free and is situated close to a base plate 96. The base plate 96 has electrical contacts 102, 104. Each cantilever 24, 26 has a mass 28, 106 incorporated in its free end 94, 100 and an electrical contact 30, 108 is located at the free end 94, 100 adjacent the mass 28, 106. Contact 30 is capable of forming an electrical circuit via the wire 42, the circuit including the electrical contact 102 on the base plate 96 and the timer (not shown). Similarly, contact 108 is capable of forming a separate electrical circuit via the wire 40, the circuit including the electrical contact 104 on the base plate 96 and the timer (not shown). The cantilevers 24, 26 are fixed to the support 90 so that their non fixed ends 94, 100 and the electrical contacts 30,108 thereon are situated close to but not touching the electrical contacts 102, 104 of the base plate 96. When subjected to an acceleration in the direction indicated by the arrow A, the cantilevers 24, 26 deflect until at a predetermined threshold acceleration value which is different for each cantilever, the contacts 30, 108 on the cantilevers 24, 26 make contact with the contacts 102, 104 on the base plate 96. As a cantilever switch closes, an electrical circuit is made and an electrical signal is sent to the timer. In this embodiment, the cantilevers 24, 26 are designed to switch at different threshold accelerations, by having a different mass 28, 106. When the first cantilever switch closes, an electrical signal is sent to the timer, causing it to start to count. When the second cantilever switch closes, another electrical signal is sent to the timer, causing it to stop counting.

Figure 4B:
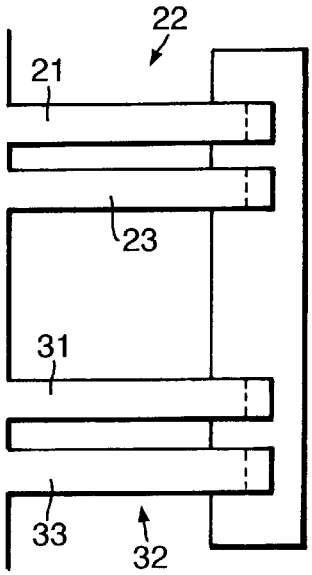

FIG. 4*b* shows two sensors 22, 32 comprising of cantilevers 21, 23, 31, 33 similar to those cantilevers 24, 26 shown in FIG. 4*a*. In this embodiment, the cantilevers 21 and 23 are designed to switch at the same pre-determined acceleration value and cantilevers 31 and 33 are designed to switch at the same threshold acceleration, which is higher than that acceleration required by the cantilevers 21, 23. Each cantilever is not part of the same circuit as any other cantilever, but each circuit sends a separate electrical signal to the timer. When both cantilevers in set 22 have closed their circuits, thereby sending electrical signals to the timer, the timer starts to count. Only when both cantilevers in set 32 have closed their circuits, thereby sending electrical signals to the timer, will the timer stop counting. This double switch system acts as a further safety measure to ensure that if one of the sensors is faulty it will not cause the ammunition to be inadvertently armed.

Figure 5:
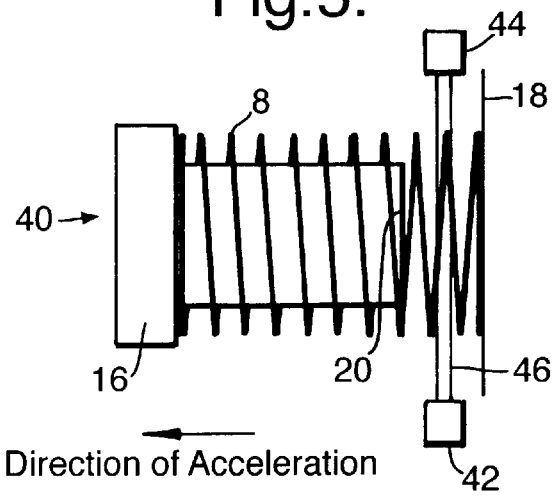
FIG. 5 shows a plan view of another spring mass acceleration sensor having an optical switch for use in a safety and arming unit according to the present invention.

FIG. 5 shows a photoelectric optical spring mass acceleration threshold switch 40 suitable for use as the acceleration sensor of FIG. 2. The switch comprises a mass 16 slotted as shown into a spring 8 which is attached to a base 18. A light beam 46 is directed between the base 18 and the end 20 of the mass 16 from a light source 42. Under an acceleration in the direction shown the resulting force acting on the mass 16 causes the spring 8 to compress until, at a predetermined position representing the threshold acceleration value, the end 20 of the mass 16 interrupts the light beam 46 and stops it from reaching a receiver 44. When the receiver 44 detects this difference in light levels it sends an electrical signal to the timer. The predetermined position can be fixed by the location of the light beam, the resilience of the spring or the mass of the mass 16.

Figure 6:
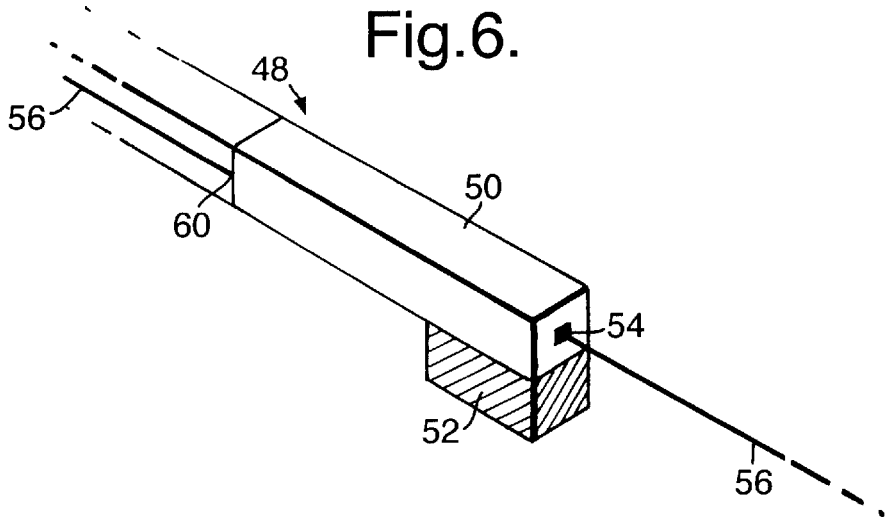
FIG. 6 shows a three dimensional view of another cantilever acceleration sensor having piezoresistive characteristics for use in a safety and arming unit according to the present invention.

FIG. 6 shows a cantilever piezoresistive acceleration sensor 48 suitable for use as the acceleration sensor of FIG. 2. A cantilever 50 having piezoresistive qualities, whereby its electrical resistivity varies with mechanical strain, has a mass 52 attached. The cantilever 50 forms part of an electrical circuit comprising electrical contacts 54, 60, wires 56, the piezoresistive cantilever 50 and a current detector (not shown) for sending an electrical signal to the timer (not shown) when a threshold current value is reached. Under an acceleration force, the cantilever 50 deflects and this mechanical strain causes its resistive properties to change, influencing the current in the circuit. Upon the detection of a threshold current value in the circuit, corresponding to the mechanical strain on the cantilever 50 due to the predetermined acceleration force, the timer is caused to start counting. One such sensor 48 may advantageously be used both to start the timer and to stop the timer, if a further signal is sent to the timer when a second threshold current value is reached. This has the advantage of needing only one sensor to start and stop the timer, and also has no moving parts which could break.

Figure 7:
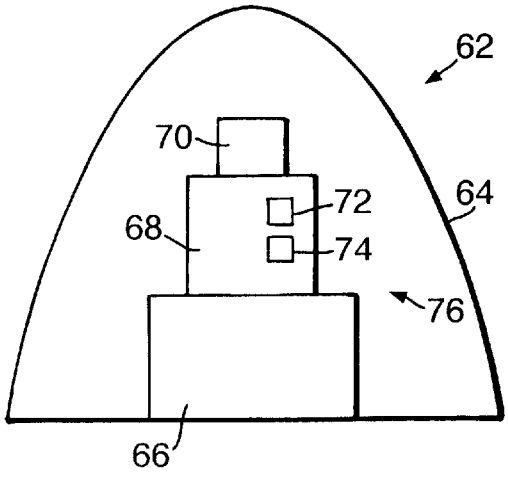
FIG. 7 shows a fuze for ammunition incorporating a safety and arming unit according to the present invention.

FIG. 7 shows a schematic fuze 64 at the forward part of an artillery shell 62, the fuze having a safety and arming unit 76 according to the present invention. The fuze 64 has a safety and arming unit 76 comprising an acceleration sensor 70, an integrated electronics pack 68 which includes an electronic timer 72, a comparator 110 and a electronically-triggered detonator 74, and a power pack 66 which supplies power to the electronics pack 68.

The safety and arming unit can be adapted for use with different natures of ammunition of the same calibre and, for artillery, can be adapted to different charges. The unit can be adapted to permit external programming of the unit with different ranges of values of predetermined or preset time intervals representing satisfactory firing conditions for different natures of ammunition and artillery charges.

It will be understood that the invention offers high levels of safety for the soldier and anyone else handling the ammunition. In addition a round of ammunition, once fired, may fail to be armed for a number of reasons which do not affect safety of the soldier, such as ring burning or irregular burning of the propellant producing a deficient acceleration profile in the barrel and causing range to be affected. The invention may therefore be adapted to avoid collateral damage by a shell falling short of or overflying the target.

What is claimed is:

1. A safety and arming unit for a round of ammunition, comprising one or more acceleration sensors for detecting when the acceleration of the round of ammunition reaches at least two different predetermined linear acceleration values; timer means for measuring the time interval between the detection of two of the predetermined linear acceleration values, means for electronically comparing said measured time interval with a range of predetermined and pre-set time intervals representing satisfactory firing for the round of ammunition, and means for producing an electronic signal when said measured time interval falls within the range of predetermined and pre-set time intervals, which signal operates to arm the round of ammunition ready for detonation.

2. A safety and arming unit according to claim 1 having at least one acceleration sensor capable of detecting at least two predetermined linear acceleration values.

3. A safety and arming unit according to claim 1 having at least two acceleration sensors, each being capable of detecting one pre-determined linear acceleration value.

4. A safety and arming unit according to claim 3 wherein at least one sensor detects a threshold lower acceleration value and at least one further sensor detects a threshold upper acceleration value.

5. A safety and arming unit according to claim 4 wherein several sensors are provided to detect the same threshold acceleration value.

6. A safety and arming unit according to claim 3 wherein the sensors are spring mass systems which act as switches being open initially and closing at a threshold acceleration value to complete an electrical circuit.

7. A safety and arming unit according to claim 3 wherein the sensors are in the form of cantilever threshold switches.

8. A safety and arming unit according to claim 3 wherein the sensors are optical spring mass acceleration threshold switches whereby a spring and mass system interrupts a light beam.

9. A safety and arming unit according to claim 1 wherein at least one acceleration sensor utilises piezoresistive material.

10. A safety and arming unit according to claim 1 wherein said at least one acceleration sensor forms an integral part of the safety and arming system of a fuze.

* * * * *